US005239947A

United States Patent [19]

Schimmeyer

[11] Patent Number: 5,239,947

[45] Date of Patent: Aug. 31, 1993

[54] VENT DAMPER FOR GAS WATER HEATER

[76] Inventor: Werner K. Schimmeyer, 8937 Acorn Pl., Santa Rosa, Calif. 95409

[21] Appl. No.: 887,338

[22] Filed: May 22, 1992

[51] Int. Cl.[5] ..... F22B 5/00

[52] U.S. Cl. ..... 122/17; 110/163; 126/285 A; 126/307 A

[58] Field of Search ..... 122/17; 110/163; 126/350 R, 285 R, 285 A, 294, 307 A; 454/20, 27, 334, 37

[56] References Cited

U.S. PATENT DOCUMENTS 3,650,198 3/1972 Stone ..... 454/37

4,442,798 4/1984 Zanias ..... 122/17

*Primary Examiner*—Edward G. Favors

*Attorney, Agent, or Firm*—Claude A. S. Hamrick

[57] ABSTRACT

A vent damper for limiting the flow of ambient air in a hot water heater including a main burner, a pilot light burner and a central core for evacuation of exhaust gases from the main burner and pilot light burner. The vent damper comprises an inner shell having legs that extend downwardly and attach to a central baffle which directs the flow stream of exhaust gases passing through the exhaust port, a closure element slidably engaged about the inner shell which is movable between an open position and a closed position, a deflector attached to the upper end of the inner shell for deflecting downdrafts and limiting the upward travel of the seal ring, and an outer shell attached to the deflector that houses the aforementioned components.

10 Claims, 5 Drawing Sheets

VENT DAMPER FOR GAS WATER HEATER

BACKGROUND OF THE INVENTION

1. Field of the Invention

This invention relates generally to water heating apparatus, and more particularly to vent dampers and flue closures for gas hot water heaters.

2. Brief Description of the Prior Art

In gas water heaters, fuel is burned in a combustion chamber located at the base of the heating unit. The water contained in the heater tank is heated by conduction through the combustion chamber where the fuel is burned, as well as by conduction through the heater's central venting passageway through which the hot combustion gases pass. These combustion gases are then exhausted via a flue.

Even after the flame is extinguished in the combustion chamber, the heated water maintains sufficient heat in the walls forming the central passageway to induce a flow of cooler ambient air therethrough. The passage of the cooler air causes substantial energy loss as the heated water is caused to cool more rapidly than would be the case if the cool ambient air were not allowed to pass through the tank and into the flue.

Existing types of flue dampening devices usually comprise a hinged, one-way mechanical valve that prevents outside air from passing through the exhaust flue. However, these devices require a significant flow of exhaust in order to open, and thus are used mostly with units having a fan or blower. Other damping devices utilize a bi-metal expansion/contraction valve to regulate flow.

Applicant's prior U.S. Pat. No. 4,770,160 discloses a more efficient form of vent damper which is incorporated into the central exhaust passageway above a hot water heater. The damper comprises a frusto-conical shaped floating poppet closure that is slidably mounted on a guide within a flue hood immediately above the heater. When the heater burner is in operation, the hot exhaust gases lift the poppet allowing the gases to escape around the poppet and into the flue. When the main burner is off, the poppet lowers into a closed position where it rests atop the tank's central passageway. In this is position, the poppet blocks the passageway and prevents the cool room air from circulating therethrough. This closure saves energy by slowing the cooling of the water and thus conserving the heat within the water tank.

Although the frusto-conical or dome shaped poppet closure provides a substantial improvement over the prior art, the shape of the poppet interrupts the vertical flow of the exhaust gas, and directs it almost horizontally. Re-directing the exhaust flow increases the risk of spillage of the exhaust gas into the building space housing the water heater. In addition, the shape of the poppet makes it expensive to manufacture, and its engagement to its guide sometimes affects its reliability.

SUMMARY OF THE INVENTION

It is therefore a primary objective of the present invention to provide an improved vent damper apparatus which is relatively inexpensive to make yet is highly reliable in operation.

Another objective of the present invention is to provide an improved vent damper apparatus for a gas water heater which in its open configuration directs the flue gases in a generally streamlined flow direction via a central baffle.

Still another objective of the present invention is to provide an apparatus of the type described having a smoother opening and closing damper which is slidably engaged with, and is guided by, ridges which protrude from the outer surface of each of a plurality of positioning legs.

A further objective of the present invention is to provide a single improved vent damper apparatus that can be used on either a 3" or 4" exhaust port.

Still another objective of the present invention is to provide an improved vent damper apparatus that permits operational lifting of the closure element even in a downdraft situation.

Briefly, a preferred embodiment of the present invention includes an annular closure element that is slidably engaged to a cylindrical inner guide including a plurality of legs with each leg having a ridge raised in relief on the outside of the leg and continuing along the length thereof. A central baffle supported by the legs directs the exhaust in a generally streamlined flow direction. An annular downdraft deflector shield is attached to the upper end of the guide and serves to direct downdrafts outwardly of the closure element. A cylindrical outer housing attached to the deflector shield rests ii atop the water heater tank top and supports the inner shell, support legs and closure assembly.

An important advantage of the present invention is that energy losses are reduced by restricting the flow of air through the central core of a gas heater tank at a time when no heat is being applied, thus conserving the heat within the tank.

These and other objects and advantages of the present invention will no doubt become apparent to those skilled in the art after having read the following detailed description of the preferred embodiment which is illustrated in the various drawing figures.

DETAILED DESCRIPTION OF THE PREFERRED EMBODIMENT

Figure 1:
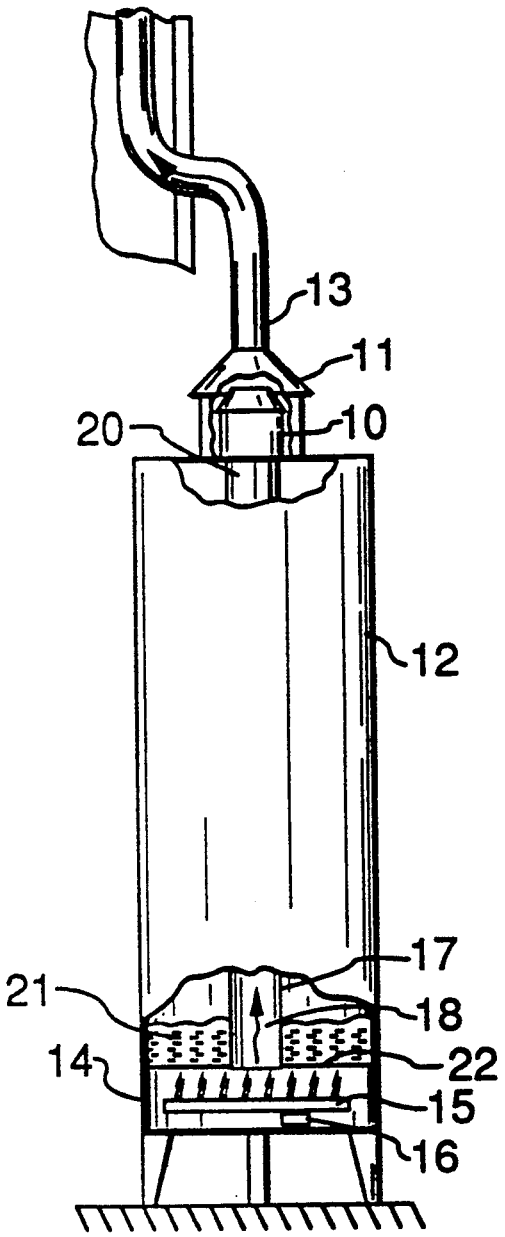
FIG. 1 is a partially cutaway elevated side view of a gas-fired hot water heater system incorporating a vent damper in accordance with the present invention.

FIG. 1 shows a partially cutaway elevated side view of a vent damper 10 of the present invention installed upon a hot water heater 12 and disposed beneath the flue hood 11 and exhaust duct 13 commonly used with water heaters. The water heater 12 includes a combustion chamber 14 which contains a main burner 15 and a pilot light 16, together with a central core 17 forming an exhaust passageway 18 that terminates at its upper end in an exhaust port 20. A water tank 21 having a base 22 surrounds the core 17. Natural gas is burned in the combustion chamber 14 to heat the water in tank 21 via conduction through the base 22 of the tank and the central core 17 through which the hot exhaust gases pass. The exhaust gases exit the top of the heater at the exhaust port 20, pass through the damper 10, flue hood 11, and out to the outside air through the exhaust duct 13 that is attached to the top of the flue hood.

Figure 2:
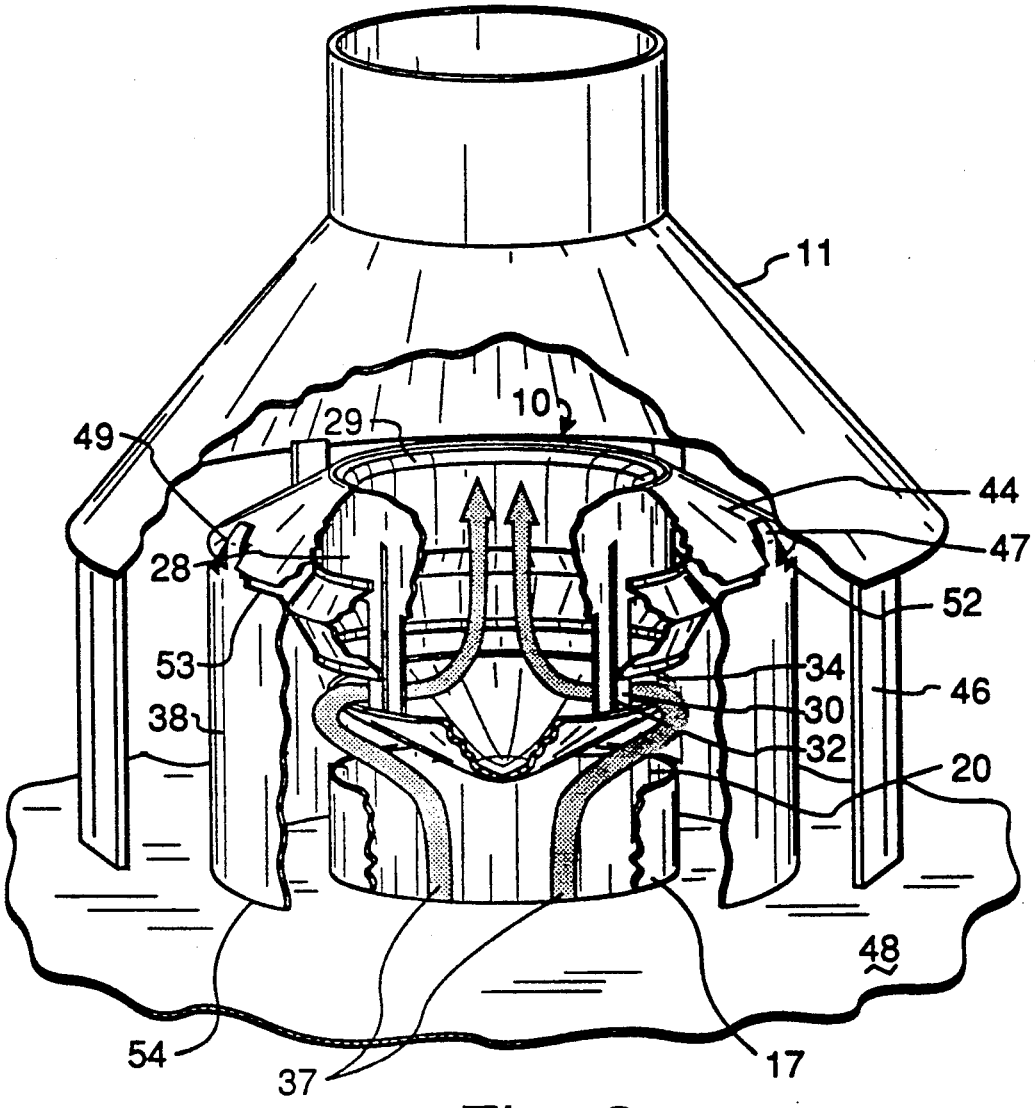
FIG. 2 is a perspective view depicting a vent damper in accordance with the present invention shown in place beneath a flue hood and exhaust duct, the damper and hood being partially broken to better illustrate the components of the preferred embodiment.

FIG. 2 illustrates the components of the vent damper 10, showing vent damper 10 and flue hood 11 in perspective and partially broken to reveal the inner workings thereof.

Figure 3:
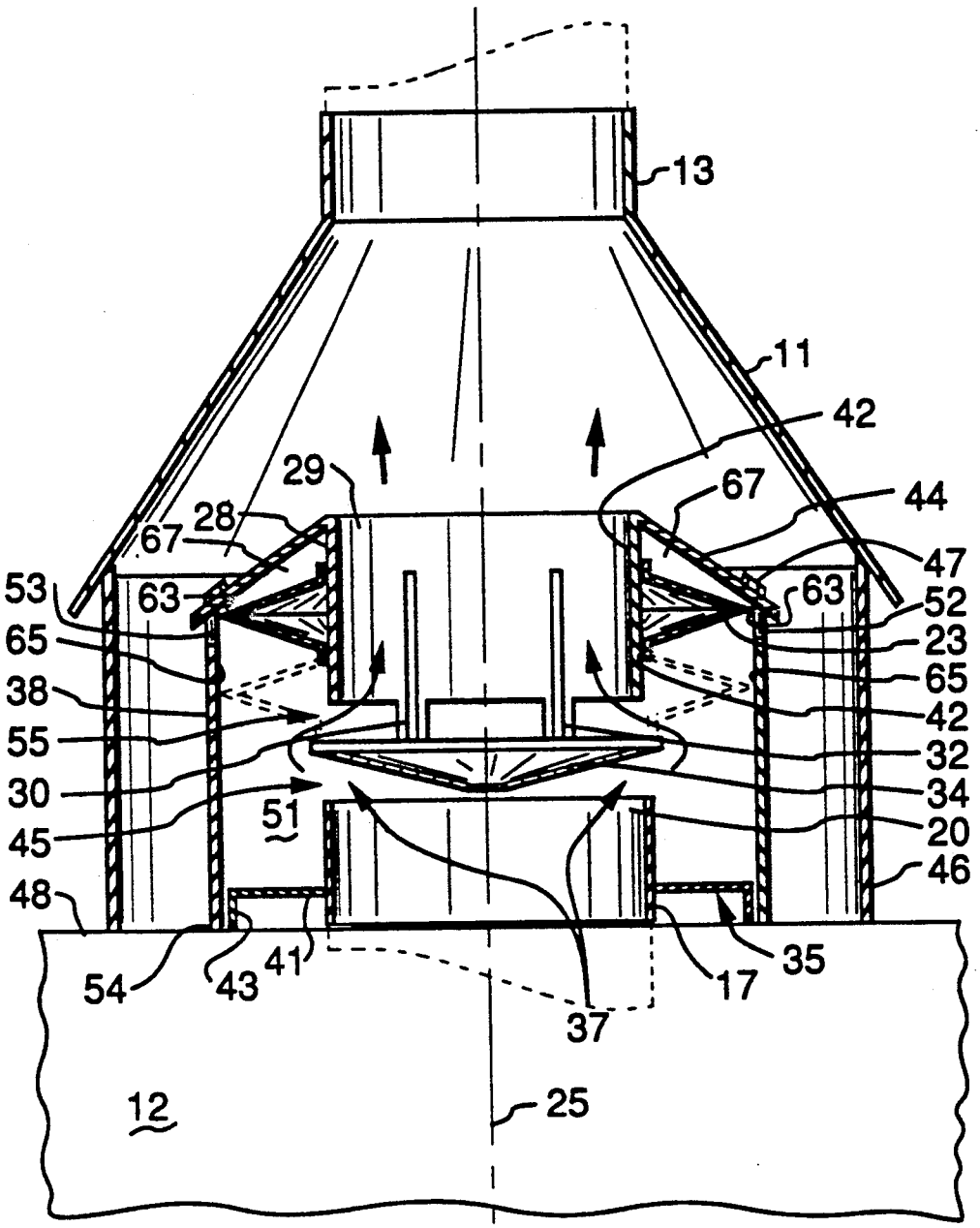
FIG. 3 is a cross-sectional view of an improved vent damper illustrating the flow of the exhaust gases when the closure element is in an open position.

FIG. 3 is an axial cross-sectional view of the vent damper 10 and flue hood 11 positioned above a three-inch exhaust port 20 and showing a closure element 23 in an open position.

Figure 4:
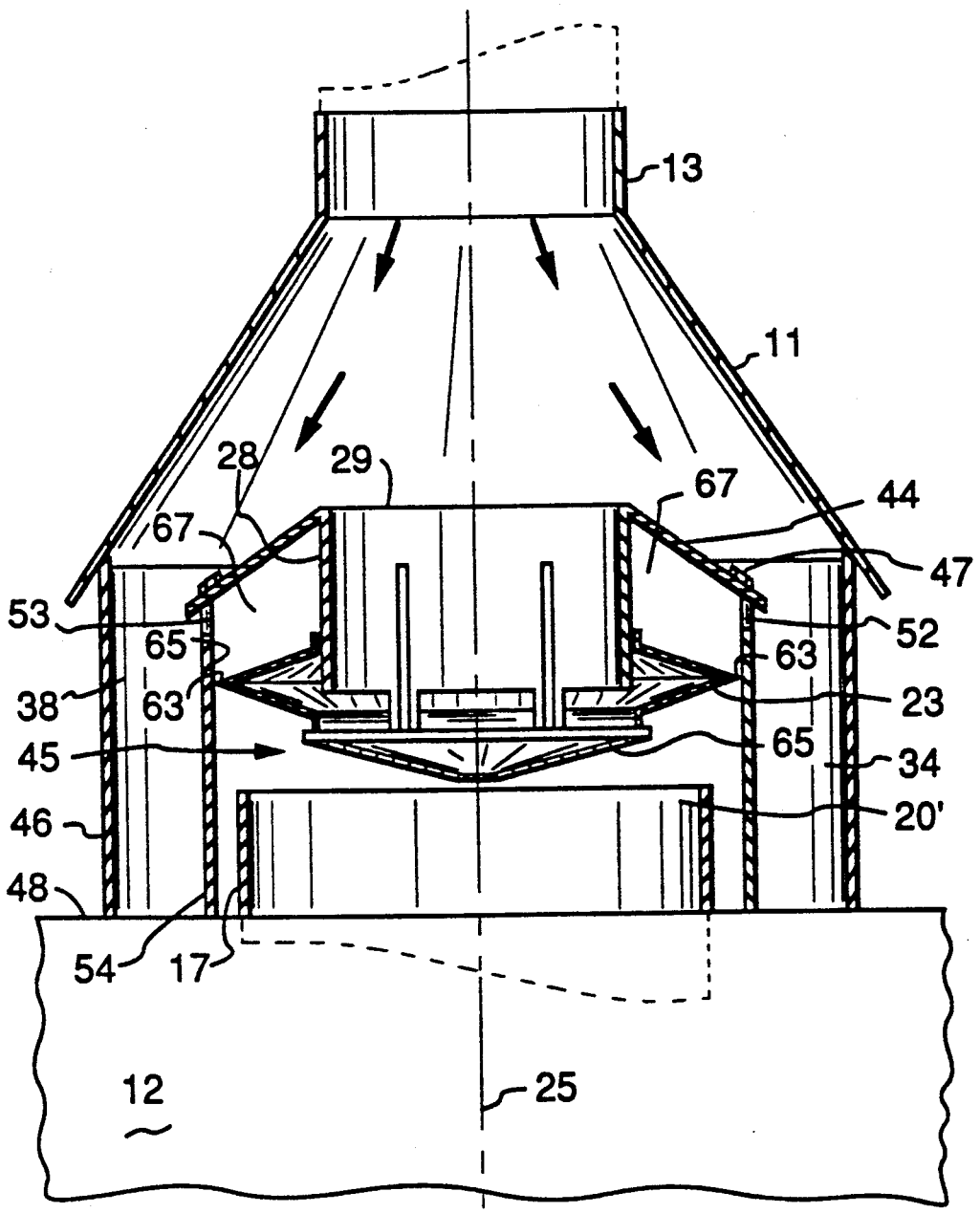
FIG. 4 is a cross-sectional view of an improved vent damper showing the closure element in a closed position.

FIG. 4 is an axial cross-sectional view of the vent damper 10 and flue hood 11 positioned above a 4-inch exhaust port 20' and showing the closure element 23 in a closed position.

As is seen in FIGS. 2, 3 and 4, the ports 20 and 20' are cylindrical upper extensions of the central core 17 that extends slightly beyond the top surface 48 of the tank 12. The cylindrical core 17 has a vertical central axis 25. Enclosed within the vent damper 10 is a guide structure 28 having a generally cylindrical upper portion 29 aligned co-axially with the central axis 25 and having a diameter that is smaller than the diameter of ports 20 and 20'. Guide structure 28 includes a plurality of elongated legs 30 which extend downwardly from the lower extremity of portion 29. A guide ridge 32 is raised in relief on the outer surface of each leg 30 and extends vertically along the center of each leg 30 and continues along the length of the portion 29 as well.

A conically shaped baffle 34 is disposed in an inverted manner between and attached to the legs 30. As will be explained in more detail below, closable exhaust passageways 55 are formed above baffle 34, between it and the lower edge of the guide structure portion 29.

The closure element 23 is engaged around the structure 28 and is free to slide up and down in sliding contact with the ridges 32 between a flow passage closing position and an open position.

A frusto-conical deflector 44 is secured to the upper rim of portion 29 and in combination with a cylindrical outer housing 38 forms a support for the guide structure 28. Deflector 44 is attached to the outer housing 38 by tabs 47 which extend upwardly beyond an upper edge 52 of the housing 38 and protrude through tab cutouts 49 in the deflector 44. The tabs 47 are bent to securely fasten the housing 38 to the deflector 44. As will be further discussed below, venting openings 53 are formed between the upper edges 52 of the housing 38 and the bottom of the deflector 44. The lower edge 54 of the cylindrical outer housing 38 rests on the top surface 48 of the water heater tank 12.

Most water heater exhaust ports 20 are either 3" or 4" in diameter. Where the improved vent damper 10 is used with a 3" port, as shown in FIG. 3, the vent damper 10 is centered about the vertical central axis 25 of the central core 17 by a centering ring insert 35. The insert 35 is L-shaped with an annular base portion 41 that is attached at its perimeter to a leg portion 43. The insert 35 is disposed invertedly, between the inner perimeter of housing 38 and the core 17, such that the base portion 41 fills the gap therebetween, thus restricting horizontal movement of the vent damper 10. The leg portion 43 raises the base portion 41 up off of the top surface 48 of the water heater tank 12 to clear a lip (not shown) that is commonly found at the junction of the water heater top surface 48 and the core 17. For a 4" port, such as is shown at 20' in FIG. 4, the lower edge 54 of the outer housing 38 mates with the port 20', the port being disposed inside the shell 38, to position the vent damper atop the water heater and restrict horizontal movement as well.

Generally speaking, the closure element 23 is a performed annular member that is movable between a first, open position, and a second, closed position. When the water heater main burner 15 is on, and hot combustion gases are rising through the heater's central core 17, the rising gases illustrated by the arrows 37 in FIG. 2, lift the closure element 23 to its open position as indicated in FIGS. 2 and 3. The upward travel of the element 23 is limited by the interference with the deflector 44. In its second, closed position, as depicted in FIG. 4, the element 23 slides down the legs 30 until it rests atop the baffle 34, thus closing off the main exhaust opening 55 to the flue. The closure element 23 is thus guided in its vertical movement by the ridges 32 of the legs 30 of the structure 28. The inner diameter of the element 23 is slightly larger than the outer diameter of the structure 28 such that the element is free to slide along the ridges 32 which run the full length of the legs 30 and portion 29. Because the inner surfaces 42 of the closure element 23 engage only the ridges 32, the surface contact between the two parts is minimal. As a consequence, frictional resistance to movement is minimal and the likelihood of any interfering buildup of moisture or corrosion or the like is unlikely.

FIG. 3 is a cross-sectional view of the improved vent damper 10 of the present invention, shown in its open position. The closure element 23 is made of an extremely light yet rigid and heat-resistant material (such as aluminum foil). Hot combustion gases rising through the heater's central core 17 when the water heater main burner is ON pass through the openings 45 and raise the pressure in the chamber 51 formed between core 17, housing 38 and element 23, and lift the element to its open position as shown in FIG. 3. The air above the element 23 is displaced by the element as it moves into its open position and passes through the gaps 53 that exist between the upper edge 52 of outer housing 38 and the conical deflector 44. With the closure element in the open position, and as indicated by the arrows 37, the exhaust gases are free to flow out of the openings 45, around the baffle 34, back in through the openings 55, and up into the entrance to exhaust duct 13.

FIG. 4 is a cross sectional view of the improved vent damper 10 of the present invention, with the closure element 23 shown in its "closed" position. When the main burner 15 of the water heater 12 is OFF, the weight of the element 23, small though it may be, will cause it to slide down the legs 30 of the structure 28 until it is stopped by engagement with the baffle 34. Thermally lifted gases in the core 17 will not be allowed to flow through the damper 10 and into the flue 13 when the element 23 is in its closed position as the element completely surrounds and closes the openings 55, with the exception of the small flow that leaks past element 23, through a small gap 63 between the element 23 and the inner wall 65 of the outer housing 38. This narrow gap 63 allows pilot light exhaust gases to escape through the core 17.

Figure 5:
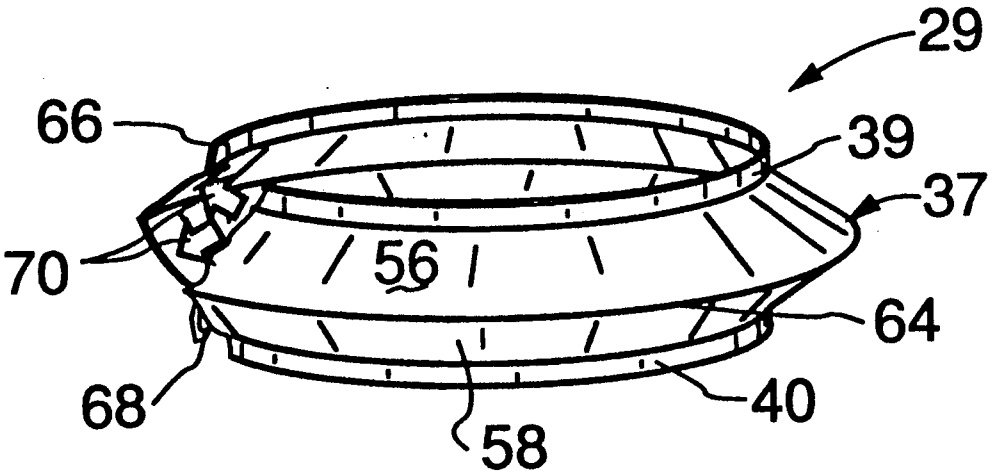
FIG. 5 is a partially broken perspective view of a closure element in accordance with the present invention, showing its shape.

The element 23 is more clearly illustrated in FIG. 5.,and is fabricated to include a pair of mirror-imaged, frusto-conical portions 56 and 58 joined together at a fold line 64, and a pair of annular ring-like portions 39 and 40 formed at the upper and lower extremities of the frusto-conical portions 56 and 58 respectively. The internal walls 66 and 68 of the ring-like portions 39 and 40 slidably engage the ridges 32 (FIG. 2) and allow the element to move freely between its upper and lower positions. Element 23 is preferably made of household (0.007") aluminum foil but may alternatively be fabricated of heavy duty aluminum foil or any lightweight material capable of handling temperatures as high as 725 degrees without materially deforming.

In a downdraft situation (such as that depicted in FIG. 4), the downward pressure from the draft acting upon the inner periphery of the closure element 23 is balanced due to the shape of the element 23. As a draft flows generally vertically through structure 28, it is re-directed at the opening to a generally horizontal direction. The shape of closure element 23 shown in FIG. 5, forces the horizontal draft to push both upwardly and downwardly on the inner periphery of the closure element 23, as indicated by arrows 70. Because the draft is acting in both directions on the closure element, the forces are balanced and the element will not be forced to open or to stay closed. The shape of the element 23 results in a further desirable feature in that a downdraft through the flue 13, in passing over shield 44, will create a slight vacuum in the air space 67 above the resting element 23 so that the element 23 will not be held closed. Such an effect is desirable in that it ensures that even in a downdraft situation, the element 23 will open when the main burner is activated and the toxic combustion gases will be able to escape from the heater core 17.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A vent damper for limiting the flow of ambient air through the central core of a hot water heater having a main burner and a pilot light burner, the central core forming an exhaust port leading to a flue for evacuation of exhaust gases from said main burner and said pilot light burner, comprising:

means forming a generally cylindrical housing, a first end of which is adapted to engage the top of a water heater in surrounding relationship to the exhaust port of said heater;

guide means including a generally cylindrical portion having a plurality of legs extending from a first end of said portion and in the axial direction thereof, said legs being positioned at intervals around the circumference thereof;

first deflector means connecting a second end of said housing to a second end of said cylindrical portion and serving to direct the flow of said exhaust gases through said vent damper;

second deflector means affixed to said legs at points spaced from said cylindrical portion, said second deflector means, said legs and said first end of said cylindrical portion combining to form a passageway through which gases entering said one end of said housing may flow and enter the space defined by said cylindrical portion and then exit said space by passing out of said second end of said cylindrical portion and into the flue; and annular closure means surrounding said cylindrical portion and adapted to slide along said legs between a first position closing said passageway and a second position opening said passageway, said closure means being configured such that exhaust gases generated in heating said water heater and passing out of said exhaust port cause said closure means to move into said second position such that said gases may flow through said passageway and into the flue, the weight of said closure means being such that in the absence of said exhaust gases it falls under the influence of gravity into said second position substantially blocking said passageway to limit the flow of ambient gases through said central core.

2. A vent damper as recited in claim 1 wherein said generally cylindrical housing engages said central core.

3. A vent damper as recited in claim 1 wherein said legs extend downwardly and engage said second deflector means.

4. A vent damper as recited in claim 1 wherein said legs include ridges disposed on the outside of said leg members to provide surface contact with said annular closure means.

5. A vent damper as recited in claim 1 wherein said second deflector means comprises a baffle member fixedly disposed relative to said central core.

6. A vent damper as recited in claim 1 wherein said annular closure means includes a closure element having a generally ring-shaped body, said body including an upper lip and a lower lip, where said body and said lips are formed to slidably engage said guide means.

7. A vent damper as recited in claim 6 including stop means for limiting the upward movement of said closure element to said second position.

8. A vent damper as recited in claim 7 wherein said stop means includes a shield means for deflecting an exhaust port downdraft away from said closure element.

9. A vent damper as recited in claim 1 wherein said vent damper further comprises centering means for locating said generally cylindrical housing means in surrounding relationship with said exhaust port of said heater.

10. A vent damper as recited in claim 1 wherein said annular closure means is configured to balance forces acting upon it in a downdraft situation.

* * * * *